US006099052A

United States Patent [19]

Spitzley

[11] Patent Number: 6,099,052

[45] Date of Patent: Aug. 8, 2000

[54] DOOR HANDLE ASSEMBLY WITH INERTIAL LOCK

[75] Inventor: Larry W. Spitzley, Mulliken, Mich.

[73] Assignee: ADAC Plastics, Inc., Grand Rapids, Mich.

[21] Appl. No.: 09/173,267

[22] Filed: Oct. 15, 1998

[51] Int. Cl.[7] ..... E05B 3/00

[52] U.S. Cl. ..... 292/336.3; 292/347; 292/DIG. 22

[58] Field of Search ..... 292/336.3, 347, 292/230, 231, 236, DIG. 22, DIG. 65, DIG. 31, 1

[56] References Cited

U.S. PATENT DOCUMENTS

| | | | |
|---|---|---|---|
| 2,710,213 | 6/1955 | Hottel . | |
| 2,864,641 | 12/1958 | Leslie | 292/336.3 |
| 3,153,553 | 10/1964 | Sandor . | |
| 3,250,558 | 5/1966 | McClintock . | |
| 3,528,695 | 9/1970 | Peters . | |
| 3,544,148 | 12/1970 | Sandor . | |
| 3,583,741 | 6/1971 | Breitschwerdt | 292/216 |
| 3,719,248 | 3/1973 | Breitschwerdt | 180/112 |
| 3,909,051 | 9/1975 | Nakai | 292/166 |
| 4,402,547 | 9/1983 | Weston et al. | 297/379 |
| 4,588,219 | 5/1986 | Kobayashi et al. | 292/336.3 |
| 4,778,207 | 10/1988 | Gergoe | 292/336.3 |
| 4,796,934 | 1/1989 | Kesel et al. | 292/336.3 |
| 5,007,668 | 4/1991 | Di Giusto | 292/216 |
| 5,011,202 | 4/1991 | Kato et al. | 292/336.3 |
| 5,092,642 | 3/1992 | Lindemayer et al. | 292/336.3 |
| 5,560,659 | 10/1996 | Dault | 292/336.3 |
| 5,632,516 | 5/1997 | Schwab | 292/336.3 |
| 5,669,642 | 9/1997 | Kang | 292/336.3 |
| 5,769,471 | 6/1998 | Suzuki et al. | 292/336.3 |

FOREIGN PATENT DOCUMENTS

| | | |
|---|---|---|
| 632123 | 1/1950 | United Kingdom . |
| 1120527 | 8/1968 | United Kingdom . |

*Primary Examiner*—B. Dayoan
*Assistant Examiner*—John B. Walsh
*Attorney, Agent, or Firm*—Young & Basile, P.C.

[57] ABSTRACT

A door handle assembly for a motor vehicle which acts to preclude inadvertent unlatching of the door in response to a side impact. The door handle assembly includes a bezel housing and a handle member including a handle portion positioned in a bowl portion of the bezel housing and a crank arm portion extending outwardly and upwardly through a slot in the bowl portion for connection to a pivot shaft. A sliding, spring biased weight is mounted on the bowl portion of the bezel proximate the location where the crank arm of the handle passes through the slot in the bowl portion. The weight moves slideably into coaction with a detent structure on the crank arm of the handle member in response to a side impact to preclude pivotal movement of the handle member in an unlatching direction.

16 Claims, 3 Drawing Sheets

DOOR HANDLE ASSEMBLY WITH INERTIAL LOCK

BACKGROUND OF THE INVENTION

This invention relates to handle assemblies for controlling the latch mechanisms on vehicle door assemblies and more particularly to such handle assemblies that include provision to preclude inadvertent opening of the latch mechanism in response to a side impact.

Vehicle doors typically include a latch mechanism for latching and unlatching the door to the vehicle body, a handle assembly positioned on the door and operative to control the latch mechanism, and a lock mechanism to selectively render the handle assembly effective or ineffective to operate the latch. It is imperative that side impact against the vehicle, resulting for example from a collision, not result in the inadvertent movement of the handle of the handle assembly to a latch release position with consequent movement of the latch to an unlatched position and consequent inadvertent opening of the door. This in general is not a problem when the door is locked since in this case the door handle is either precluded from movement by the lock mechanism or the door handle is allowed to freewheel to its unlatched position but this movement is ineffective to move the latch to its unlatched position. However, when the door is unlocked, as is most typically the case in an operating vehicle, side impact can easily result in inertial movement of the door handle to its unlatched position with consequent unlatching of the latch mechanism, consequent opening of the door, and consequent discharge of unbuckled vehicle passengers from the vehicle.

Various attempts have heretofore been made to address the side impact problem and specifically to avoid inadvertent opening of the vehicle door in a side impact situation. In a commonly employed arrangement, a heavy duty spring is employed in association with the door handle. This spring may be sized, for example, to preclude movement of the door handle to its open position in crash situations involving up to 30 Gs of impact force. Whereas this arrangement satisfies the existing Federal Motor Vehicle Safety standards with respect to side impact, it also results in a door handle that is very difficult to open because of the heavy duty spring employed in association with the door handle. This arrangement has the further disadvantage that the magnitude of the side impact force that the door handle assembly can withstand without inadvertent opening of the door is limited by the strength of the spring associated with the door handle so that, for example, if the door handle spring is sized to resist a 30 G impact force, any side impact force in excess of 30 G will result in opening of the door. Other attempts to address the side impact problem have employed mechanisms that block movement of the door handle to a door unlatching position in response to a side impact but these blocking mechanisms have been complicated and expensive.

SUMMARY OF THE INVENTION

This invention is directed to the provision of an improved door handle assembly for use with a vehicle door.

More specifically, this invention is directed to the provision of a motor vehicle door handle assembly that operates to preclude inadvertent opening of the door in the event of a side impact against the vehicle.

The motor vehicle door handle assembly of the invention is intended for use in actuating a door latch of the vehicle to allow opening and closing of the vehicle door and includes a bezel and a door handle member mounted on the bezel for pivotal movement between a closed position in which the latch maintains the door in a closed position and an open position in which the latch is unlatched to allow opening of the door. According to the invention, the door handle member includes a handle portion adapted to be grasped to pivot the handle member and a crank arm portion extending between the handle portion and the pivot axis and defining a detent structure, and the handle assembly further includes a weight assembly mounted on the bezel for inertial movement in response to a side impact from a rest position clear of the crank arm portion of the handle member to a blocking position engaging the detent structure of the handle member crank arm portion to preclude inadvertent opening movement of the handle. This arrangement provides a simple and effective structure for precluding inadvertent opening movement of the door handle in a side impact situation.

According to a further feature of the invention, the door handle assembly further includes a spring yieldably resisting the inertial movement of the weight assembly and the spring acts to instantaneously return the weight assembly to its rest position following the side impact. This arrangement ensures that, irrespective of the attitude of the vehicle following the side impact, the door may be readily opened from outside the vehicle to allow rescue of occupants within the vehicle.

According to a further feature of the invention, the weight assembly is mounted for sliding movement between its rest and blocking positions. The arrangement provides a quick, positive movement of the weight into its blocking position.

According to a further feature of the invention, the weight assembly includes a guide defining a pair of parallel tracks and a weight mounted for sliding movement on the parallel tracks. This arrangement provides a smooth, positive movement of the weight.

According to a further feature of the invention, the bezel includes a slot; the handle crank arm portion passes through the slot; and the weight is mounted on the bezel proximate the slot for sliding movement to its blocking position engaging the handle crank arm portion as it passes through the slot. This arrangement provides ready and positive access to the crank arm portion by a weight mounted on the bezel.

In the disclosed embodiment of the invention, the guide has a U-configuration including parallel legs defining the parallel tracks and the spring comprises a coil spring positioned on each guide leg between the weight and the bezel. The springs normally maintain the weight in a rest position removed from the path of movement of the handle crank arm portion but readily yield in a side impact situation to allow spring resisted inertial movement of the weight into a position instantaneously blocking the handle crank arm portion, whereafter the springs act to instantaneously return the weight to its rest position to allow opening of the door.

DETAILED DESCRIPTION OF THE PREFERRED EMBODIMENT

Figure 1:
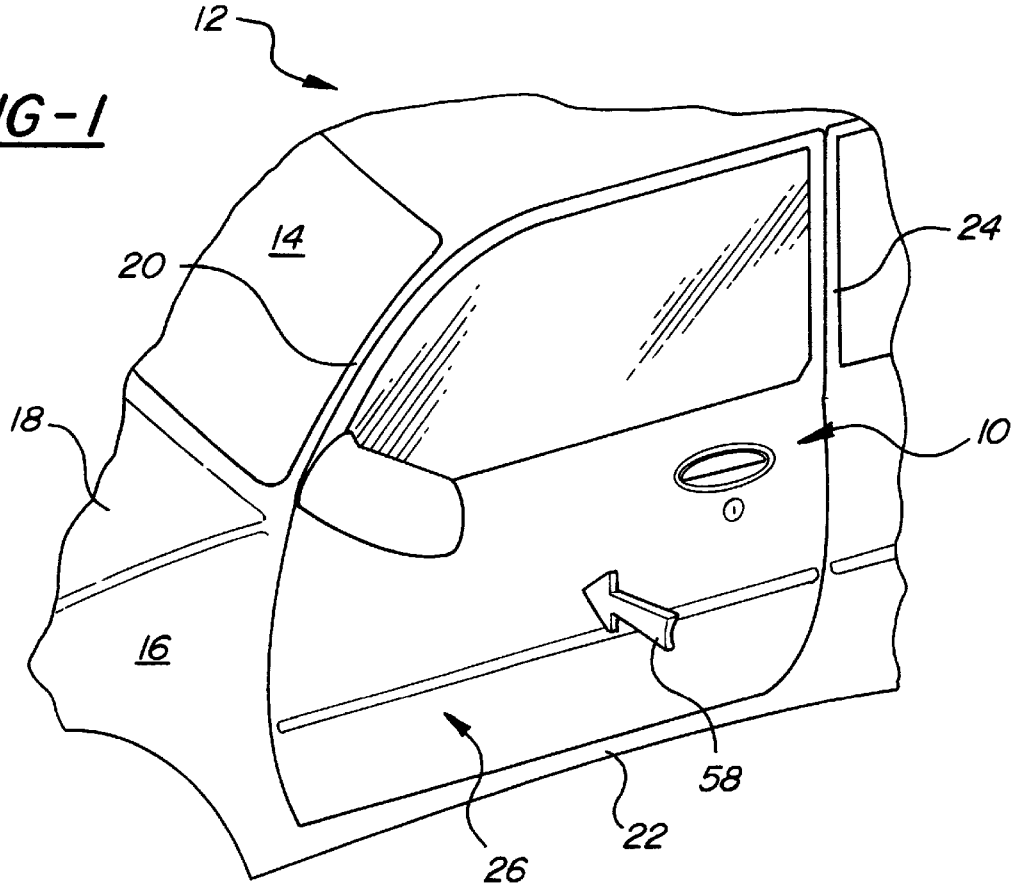
FIG. 1 is a fragmentary perspective view of a motor vehicle including a door embodying the door handle assembly of the invention.
Figure 2:
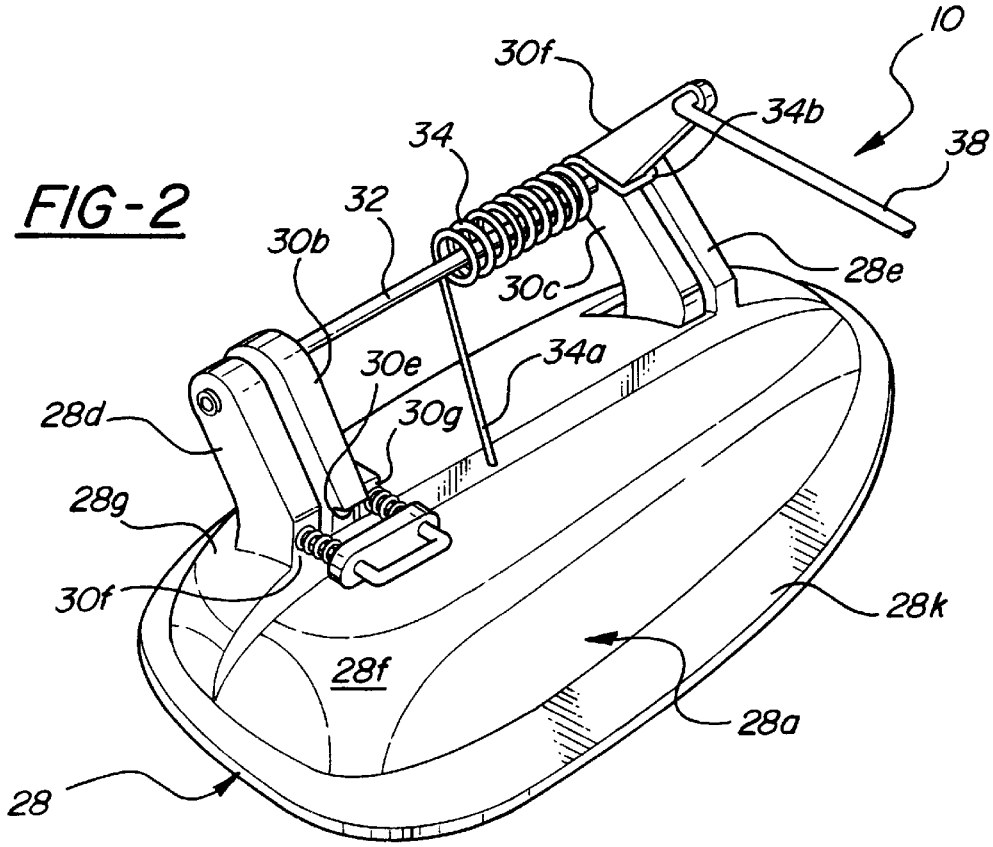
FIG. 2 is a perspective view of the invention door handle assembly.
Figure 3:
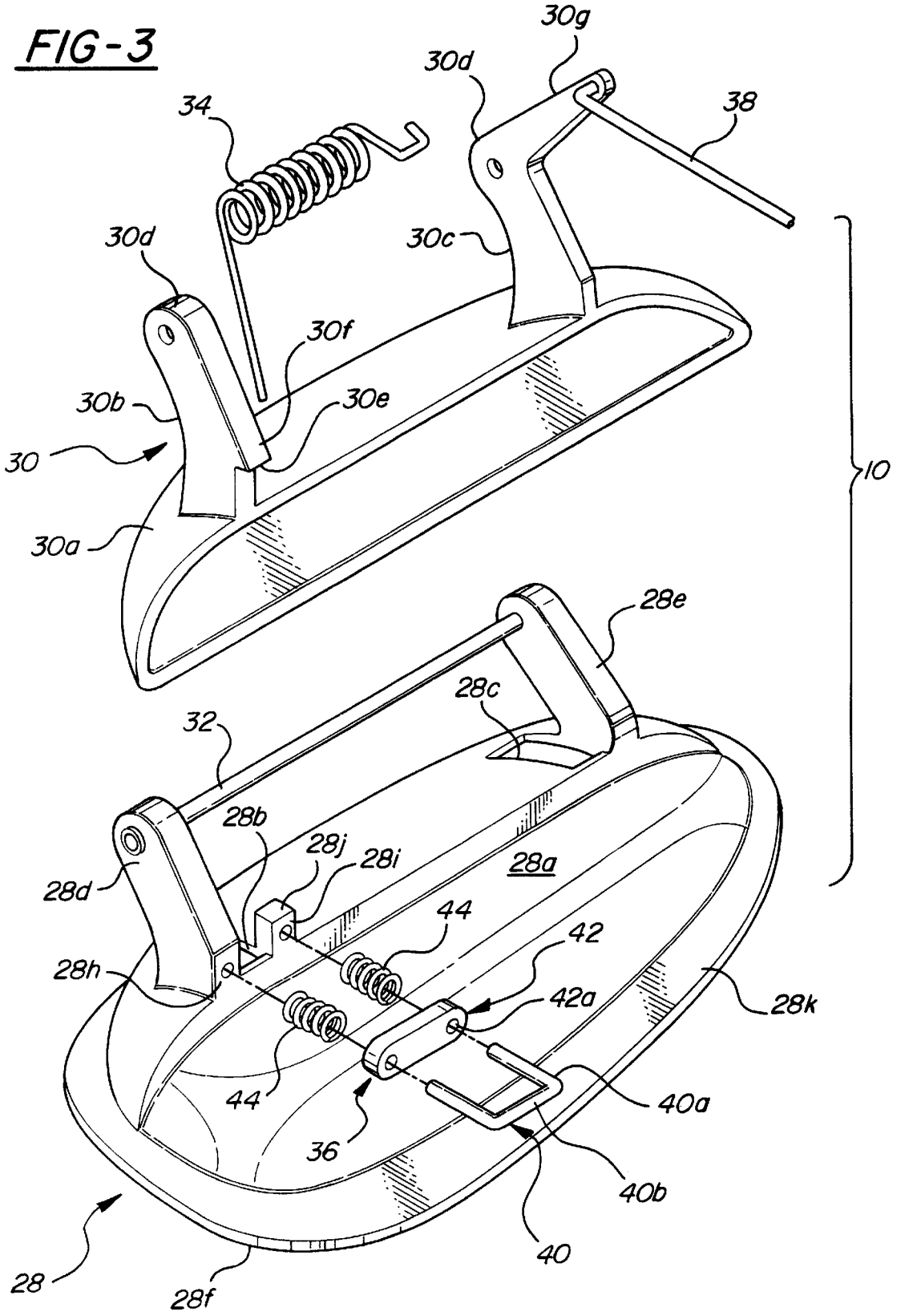
FIG. 3 is an exploded view of the invention door handle assembly.

The invention door handle assembly 10 is seen in FIG. 1 in association with a fragmentarily show motor vehicle 12 including a windshield 14, a front quarter panel 16, a hood 18, an A-pillar 20, a sill 22, a B-pillar 24, and a door 26 positioned in the door opening defined by A-pillar 20, front quarter panel 16, sill 22, and B-pillar 24.

Door handle assembly 10 includes a housing or bezel 28, a handle member 30, a pivot shaft 32, a coil spring 34, and a weight assembly 36.

Bezel or housing 28 includes a main body bowl portion 28*a* defining laterally spaced rectangular slots 28*b*, 28*c* and a pair of laterally spaced lug portions 28*d*, 28*e* extending outwardly and rearwardly from the bowl portion. Lug portion 28*d* is positioned immediately outboard of slot 28*b* and lug portion 28*e* is positioned immediately outboard of slot 28*c*. Bowl portion 28*a* has a U or V-shaped configuration in cross-section (FIG. 4) and includes a lower arcuate section 28*f* and an upper arcuate section 28*g*. Slots 28*b*, 28*c* are provided in laterally spaced relation in upper bowl portion 28*e* and lug portions 28*d*, 28*e* extend outwardly and upwardly from upper bowl portion 28*e* in proximity to respective slots 28*b*, 28*c*.

Handle member 30 includes a handle portion 30*a* of inverted V-shaped cross sectional configuration (FIG. 4) positioned in housing bowl portion 28*a*, and laterally spaced crank arm portions 30*b*, 30*c* extending outwardly and upwardly from handle portion 30*a* and passing through respective slots 28*b*, 28*c* in the housing bowl portion.

Pivot shaft 32 extends between the upper ends of housing lug portions 28*d*, 28*e* and mounts the upper ends 30*d* of lugs 30*b*, 30*c* whereby to mount the handle member for pivotal movement about the axis defined by pivot shaft 32. Lug portion 30*b* defines a detent structure in the form of a notch 30*e* formed in the rear arcuate face 30*f* of the lug portion. Lug portion 30*c* includes a tail or actuator portion 30*g* for attachment to a control link 38 to actuate the latch of the vehicle door in known manner in response to pivotal movement of the handle member.

Figure 4:
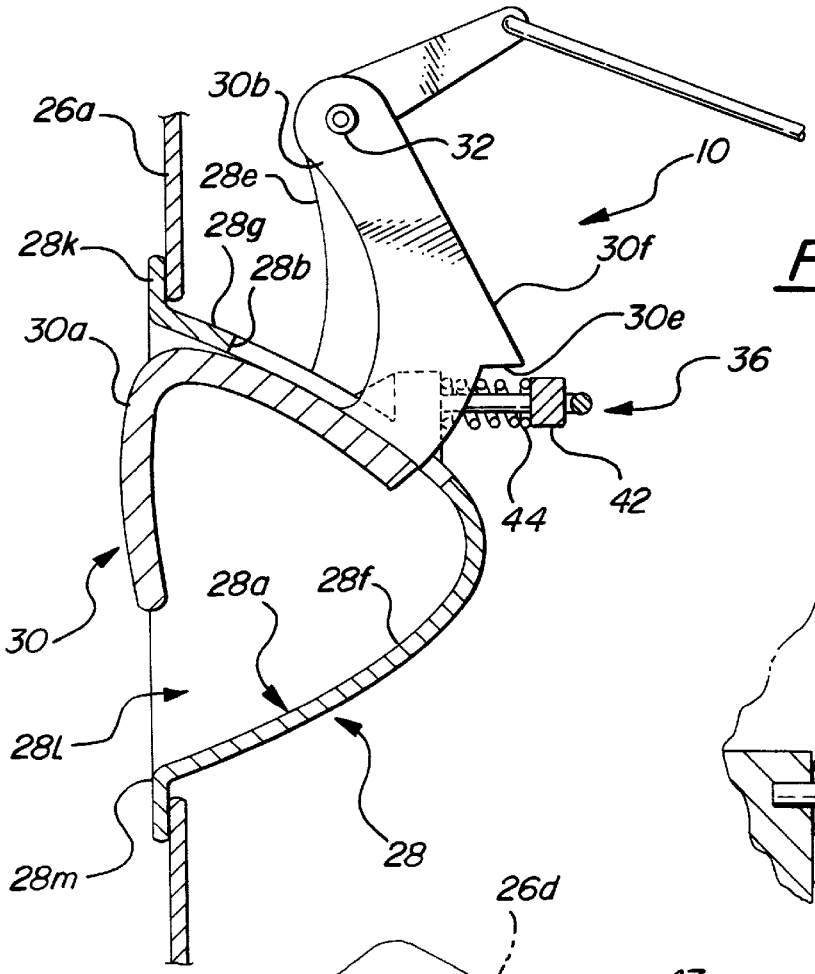
FIG. 4 is a cross-sectional, somewhat schematic view showing the invention door handle assembly positioned in a door of the motor vehicle.

Coil spring 34 is positioned around pivot shaft 32 and includes an end 34*a* bearing against the rear face of bowl upper portion 28*g* and an opposite end 34*b* hooked around crank arm portion 30*c* proximate actuator portion 30*f*. Spring 34 will be seen to resiliently resist opening movement of the handle (in a clockwise direction about the axis of pivot shaft 32 as seen in FIG. 4) and to normally maintain the handle member in the rest or latched position seen in FIG. 4 in which the handle portion of the handle member is seated firmly within the bowl portion of the bezel housing.

Weight assembly 36 includes a guide member 40, a weight 42, and a pair of coil springs 44.

Guide member 40 has a U-configuration defining a pair of parallel legs 40*a* and an outboard bight portion 40*b*.

Weight 42, which may be formed of a suitable high density metallic material, has an oval configuration including bores 42*a* sized to slideably pass legs 40*a* whereby to mount the weight for sliding movement on the legs 40*a*.

Coil springs 44 are positioned around legs 40*a*. The free ends of legs 40*a* are respectively fixedly mounted on a vertical rear face 28*h* of lug portion 28*d* and on a vertical rear face 28*i* of an anchor structure 28*j* formed integrally with the bezel bowl portion. Springs 44 are positioned between the weight and the bezel to urge the weight to a rest or inactive position (FIG. 4) in which the weight is urged against the bight portion 40*b* of the guide. Vertical faces 28*h*, 28*d* will be seen to straddle the lower end of slot 28*b* so that guide 40 is positioned in straddling relation to the lower end of slot 28*b* and so that weight 42 is positioned proximate the lower end of slot 28*b*.

In the assembled relation of the door handle assembly, handle portion 30*a* of the handle member is positioned within the bowl portion 28*a* of the bezel housing; the crank arms of the handle member extend upwardly and outwardly through respective slots 28*b*, 28*c* in respective juxtaposition to inboard faces of lug portions 28*d*, 28*e*; the upper free ends of the crank arms are mounted on pivot shaft 32 to mount the handle member for pivotal movement between latching and unlatching positions; spring 34 acts to urge the handle member to its latched position seen in FIG. 4 while allowing spring resisted pivotal movement of the handle, in a clockwise direction as seen in FIG. 4, to unlatch the associated door latch mechanism; and weight 42 is maintained by springs 44 in a position proximate the lower end of slot 28*b* but clear of the path of movement of crank arm 30*b* so that the handle member may move freely against the resistance of spring 34 between latched and unlatched positions.

As seen in FIG. 4, handle assembly 10 is positioned in the outer skin 26*a* of door 26 by suitably securing the peripheral flange 28*k* of the bezel to the outer skin to position the bezel cavity 281 rearwardly of the outer skin and within the door and position the bezel window 28*m* generally flush with the door outer skin.

Figure 6:
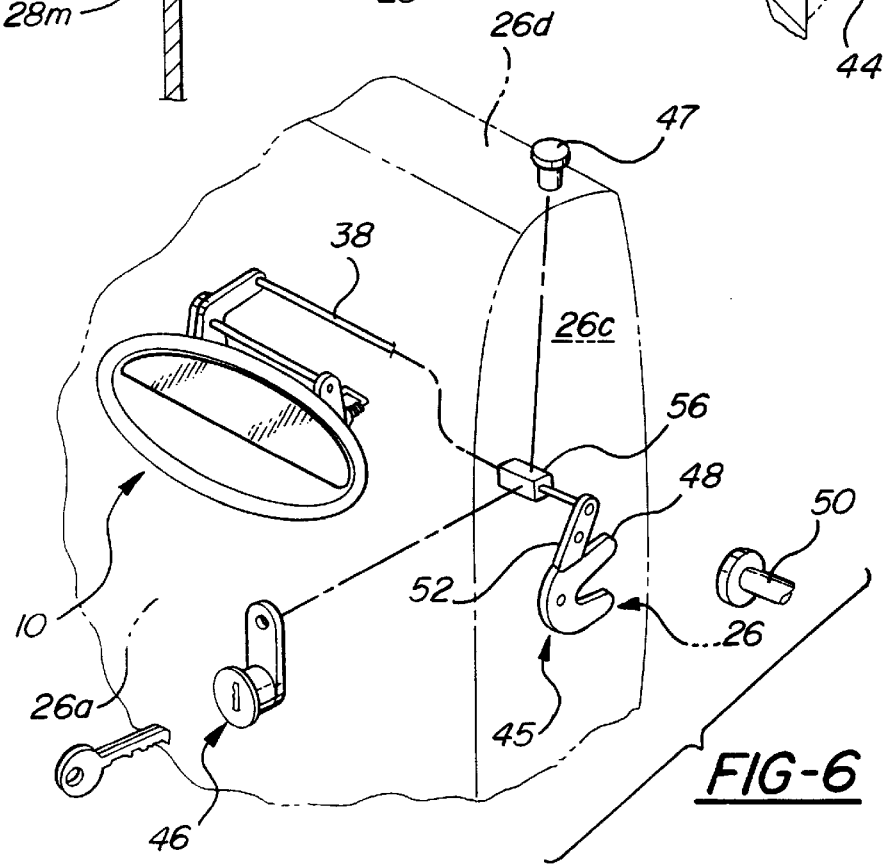
FIG. 6 is a perspective, fragmentary, somewhat schematic view invention door handle assembly incorporated in a vehicular door assembly.

As seen in FIG. 6, handle assembly 10 is intended for use with a vehicle door assembly including door 26, a latch assembly 45 positioned on the shut face 26*c* of the door, a key cylinder lock 46 positioned in the outer skin 26*a* of the door proximate door handle assembly 10, and a push button lock 47 positioned on the top sill 26*d* of door 26 in overlying relation to latch assembly 45 and coupled for joint operation with key cylinder lock 46. Latch assembly 45 is of known form and includes a latch member 48 coacting with a bolt 50 on the confronting face of the vehicular structure to pivotally move the latch member 48 between latched and unlatched positions. Latch assembly 45 further includes a dog 52 coacting with a detent on latch member 48 to maintain the latch member in its latched condition against the bias of a spring (not shown) and operative when released to allow the latch member to return under the bias of the spring to the unlatched position and thereby move the door to an unlatched position. Dog 50 is controlled in known manner by control link 38 whereby pivotal movement of crank arm 30*c* with key cylinder 44 and push button 47 in an unlocked condition has the effect of releasing the latch member 48 for movement to an unlatched position. However, latch assembly 45 in known manner further includes a decoupling mechanism 56 (shown schematically) which serves to render control link 38 ineffective to release the latch member 48 when the push button 47 and lock cylinder 46 are in a locked condition.

Figure 5:
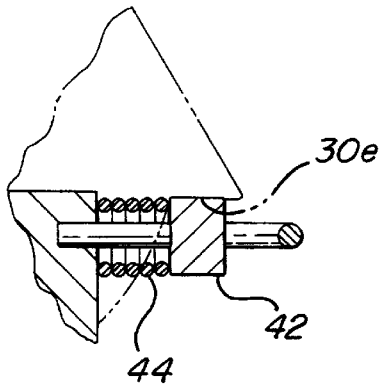
FIG. 5 is a schematic fragmentary view showing the door handle assembly in a blocking position.

In the operation of the invention door handle assembly, door handle 30 is normally free to move between latched and unlatched position to latch and unlatch the latch assembly 45 as desired. However, in the event of a side impact against the vehicle, as schematically represented by the arrow 58 in FIG. 1, handle 30 will be precluded from any significant rotational movement of the handle about the axis of pin 32 in response to the impact 58 by the immediate and positive sliding inertial movement of weight 42 on legs 40*a* to the blocking position seen in FIG. 5 wherein the weight occupies a blocking position immediately beneath detent notch 30*e* and coacts with detent notch 30*e* to instantaneously preclude movement of the door handle in an unlatching direction and thereby preclude inadvertent inertial movement of the handle to its unlatched position with consequent movement of the latch member 48 to an unlatched position and consequent unlatching of the door. The movement of the weight to its blocking position in coaction with detent notch 30*e* is instantaneous and the weight is maintained in its blocking position only so long as the side impact force is maintained. Since the side impact force is typically instantaneous, the movement of the weight into blocking position is instantaneous and the movement of the weight out of blocking position under the force of springs 44 is also instantaneous. That is, once the side impact force has dissipated, the weight is free to move back to its rest or non-blocking position as seen in FIG. 4 under the urging of springs 44. As a result, irrespective of the attitude of the vehicle following an accident, the door may be readily opened from outside the vehicle to allow rescue of occupants within the vehicle. pivotal movement of the handle from its latched to its unlatched position will of course have no effect on the latching member 48 if the lock mechanism 44/46 are in a locked condition since in this situation the coupler 56 will act to decouple any movement of the link 38 from the dog 52 and result in the handle simply freewheeling with no consequent unlatching of the door. However, the most typical operating mode of a moving vehicle involves unlocked doors and, in this most common scenario, side impact, if not guarded against in a manner such as in accordance with the present invention, can readily result in inertial movement of the handle to an unlatched position with consequent unlatching of the door. As noted, however, this inadvertent unlatching movement of the handle and consequent unlatching of the door is effectively averted in the door handle assembly of the present invention wherein the instantaneous detenting coaction between the weight and the detent notch acts to instantaneously interrupt any attempt on the part of the handle to move inertially to its unlatched position in response to an impact against the side of the vehicle.

The invention door handle assembly will be seen to provide an effective means of precluding inadvertent unlatching of the vehicle door latch mechanism in the event of side impact while yet allowing the ready operation of the door handle assembly immediately following an accident scenario as well as under normal operating conditions. Further, the invention door handle assembly is simple in construction and operation, adapts readily to a wide variety of door configurations, and provides an aesthetically pleasing appearance.

Whereas a preferred embodiment of the invention has been illustrated and described in detail it will be apparent that various changes have been made in the disclosed embodiment without departing from the scope or spirit of the invention.

What is claimed is:

1. A motor vehicle door handle assembly for actuating a door latch of the vehicle to allow opening and closing of the vehicle door, the door handle assembly including a bezel, a door handle member mounted on the bezel for pivotal movement about a pivot axis between a closed position in which the latch maintains the door in a closed position and an open position in which the latch is unlatched to allow opening of the door, characterized in that:

the door handle member includes a handle portion adapted to be grasped to pivot the handle member and a crank arm portion extending between the handle portion and the pivot axis and defining a detent structure; and the handle assembly further includes a weight mounted on the bezel for inertial movement in response to a side impact against the door from a rest position clear of the crank arm portion of the handle member to a blocking position engaging the detent structure of the handle member crank arm portion to preclude inadvertent opening movement of the handle;

said door handle assembly further including a spring yieldably resisting the inertial movement of the weight; and said spring acting to instantaneously return the weight to the rest position following a side impact.

2. A motor vehicle door handle assembly according to claim 1 wherein the weight is mounted for sliding movement between the rest and blocking positions.

3. A motor vehicle door handle assembly according to claim 2 further comprising a guide defining a pair of parallel tracks, the weight mounted for sliding movement on the parallel tracks.

4. A motor vehicle door handle assembly according to claim 3 wherein:

the bezel includes a slot;

the handle crank arm portion passes through the slot; and the pair of parallel tracks are positioned on opposite sides of the slot in flanking relation to the handle crank arm portion.

5. A motor vehicle door handle assembly according to claim 4 wherein;

the guide has a U-configuration including parallel legs defining the parallel tracks; and further comprising a coil spring positioned on each guide leg between the weight and the bezel.

6. A motor vehicle door handle assembly for actuating a door latch of the vehicle to allow opening and closing of the vehicle door, the door handle assembly comprising:

a housing including a main body bowl portion defining laterally spaced slots and a pair of laterally spaced lug portions extending outwardly from the bowl portion;

a pivot shaft extending between the housing lug portions;

a door handle member including a handle portion positioned within the housing bowl portion and laterally spaced crank arm portions extending outwardly from the handle portion, passing through respective slots in the housing bowl portion, and having free ends mounted on the pivot shaft; and a weight mounted on the housing for sliding movement between a rest position allowing free pivotal movement of the door handle member and a blocking position precluding opening movement of the door handle member.

7. A motor vehicle door handle assembly according to claim 6 wherein;

one of the crank arm portions of the handle member defines a detent structure; and the weight slides inertially into a position engaging the detent structure in response to a side impact against the door.

8. A motor vehicle door handle assembly according to claim 7 further comprising a guide defining a pair of parallel tracks, the weight mounted for sliding movement on the parallel tracks.

9. A motor vehicle door handle assembly according to claim 8 wherein the pair of parallel tracks are positioned on opposite sides of the slot passing said one crank arm portion in flanking relation to said one crank arm portion.

10. A motor vehicle door handle assembly according to claim 9 wherein;

the guide has a U-configuration including parallel legs defining the parallel track; and further comprising a coil spring positioned on each guide leg.

11. A motor vehicle door handle assembly for actuating a door latch of the vehicle to allow opening and closing of the vehicle door, the door handle assembly comprising:

a housing including a main body bowl portion defining a slot and means defining a pivot axis;

a door handle member including a handle portion positioned within the housing bowl portion and a crank arm portion extending outwardly from the handle portion, passing through the slot in the housing bowl portion and having a free end mounted on the pivot axis; and a weight mounted on the housing proximate the slot for sliding movement between a rest position allowing free pivotal movement of the door handle member and a blocking position engaging the crank arm portion as it passes through the slot to preclude opening movement of the door handle member.

12. A motor vehicle door handle assembly according to claim 11 wherein:

the crank arm portion of the handle member defines a detent structure; and the weight slides inertially into a position engaging the detent structure in response to a side impact against the door.

13. A motor vehicle door handle assembly according to claim 12 further comprising a guide defining a pair of parallel tracks positioned on opposite sides of the slot, the weight mounted for sliding movement on the parallel tracks.

14. A motor vehicle door handle assembly according to claim 13 wherein;

the guide has a U-configuration including parallel legs defining the parallel tracks;

a coil spring is positioned on each guide leg; and the legs are mounted on the housing bowl portion on opposite sides of the slot.

15. A motor vehicle door handle assembly for actuating a door latch of the vehicle to allow opening and closing of the vehicle door, the door handle assembly including a bezel, a door handle member mounted on the bezel for pivotal movement about a pivot axis between a closed position in which the latch maintains the door in a closed position and an open position in which the latch is unlatched to allow opening of the door, characterized in that:

the door handle member includes a handle portion adapted to be grasped to pivot the handle member and a crank arm portion extending between the handle portion and the pivot axis and defining a detent structure; and the handle assembly further includes a weight mounted on the bezel for inertial movement along a linear path in response to a side impact against the door from a rest position clear of the crank arm portion of the handle member to a blocking position engaging the detent structure of the handle member crank arm portion to preclude inadvertent opening movement of the handle.

16. A motor vehicle door handle assembly according to claim 15 wherein:

the door handle assembly further includes a spring yieldably resisting the linear inertial movement of the weight; and the spring acts to instantaneously return the weight to its rest position following the side impact.

* * * * *